United States Patent [19]

Roberts

[11] 4,087,317

[45] May 2, 1978

[54] HIGH YIELD, LOW COST CELLULOSIC PULP AND HYDRATED GELS THEREFROM

[75] Inventor: James R. Roberts, Sao Paulo, Brazil

[73] Assignee: Eucatex S.A. Industria e Comercio, Sao Paulo, Brazil

[21] Appl. No.: 601,419

[22] Filed: Aug. 4, 1975

[51] Int. Cl.[2] ..... D21B 1/12; D21B 1/16; D21C 3/02

[52] U.S. Cl. ..... 162/23; 162/24; 162/26; 162/28; 162/90; 162/187; 106/204; 106/123 LC

[58] Field of Search ..... 162/23, 25, 24, 26, 162/28, 90, 70, 187; 106/204, 123 LC

[56] References Cited

U.S. PATENT DOCUMENTS

| | | | |
|---|---|---|---|
| 1,631,834 | 6/1927 | Schoryer | 162/24 |
| 1,857,433 | 5/1932 | Cudwise | 162/24 |
| 2,008,892 | 7/1935 | Asplund | 162/23 |
| 2,182,250 | 12/1939 | Schwabe et al. | 162/90 X |
| 2,214,893 | 9/1940 | Hassel | 162/24 |
| 2,215,353 | 9/1940 | Gill | 162/28 X |
| 2,454,532 | 11/1948 | Walter | 162/90 |
| 2,956,918 | 10/1960 | Snyder | 162/90 |
| 3,013,932 | 12/1961 | Hinrichs et al. | 162/90 X |
| 3,192,102 | 6/1965 | Nolan | 162/24 |
| 3,379,609 | 4/1968 | Roberts | 162/181 R |
| 3,388,037 | 6/1968 | Asplund et al. | 162/23 |
| 3,607,618 | 11/1967 | Uschmann | 162/24 |

FOREIGN PATENT DOCUMENTS

| | | | |
|---|---|---|---|
| 670,451 | 9/1963 | Canada | 162/70 |

OTHER PUBLICATIONS

Rydholm; *Pulping Processes* p. 351, Interscience Publishers; New York, 1965.

Neale et al "Strengthening Cucalypt Groundwood by Alkalis and Bleaching by Hydrochlorites" Australian Pulp & Paper Ind, Tech. Assoc. Proc. 4:134–66 (1950)

*Abstract Bulletin Institute of Paper Chemistry* vol. 21, No. 8, p. 534.

*Primary Examiner*—S. Leon Bashore
*Assistant Examiner*—Steve Alvo
*Attorney, Agent, or Firm*—Eugene D. Farley

[57] ABSTRACT

Cellulosic pulp is made in 85% yield by mechanically defiberizing lignocellulose in a steam atmosphere, mixing the resulting aqueous fibrous pulp with a lignocellulose-pulping quantity of finely divided lime, and digesting the pulp in the presence of the lime to a predetermined degree of pulp digestion. The resulting digested fiber can then be mechanically beated in aqueous medium until it is substantially converted to a hydrated cellulosic gel product.

7 Claims, No Drawings

HIGH YIELD, LOW COST CELLULOSIC PULP AND HYDRATED GELS THEREFROM

BACKGROUND OF THE INVENTION

This invention pertains to a process of making lignocellulosic pulp. It pertains particularly to a process of making lignocellulosic pulp in high yield at low cost by first mechanically defiberizing lignocellulose in an atmosphere of steam and thereafter digesting the pulp in the presence of lime.

The conversion of lignocellulose to fibrous pulps is a sophisticated art which supplies to industry on the large commercial scale pulp products ranging from the mechanically produced pulps through the semi-chemical pulps, to the highly refined, bleached full-chemical pulps, which preserve fiber length to a high degree. Need nevertheless exists for a process which will convert lignocellulose rapidly and easily, at low cost, to high yields of a fibrous pulp having a degree of refinement greater than that possessed by mechanically produced groundwood, and accordingly applicable to uses not requiring long fiber length, but to which the mechanically produced pulps are not adaptable.

Such an application exists, for example, in the manufacture of hydrated cellulosic gels. These gels have important uses, including applications as adhesives. They currently are produced by mechanically refining cellulose fibers in aqueous medium under conditions such that the cellulose takes on water of hydration in varying degree and is converted to a gel. Purely mechanical pulps which may be produced in high yield are not suitable for this conversion. Accordingly, full chemical pulps which are obtainable from lignocellulose in yields of only about 46% by weight are employed as raw materials for cellulosic gel making.

It obviously would be an advantage, and it is an object of this invention, to provide a process for converting lignocellulose to a cellulosic pulp suitable for use in the manufacture of hydrated cellulosic gels, the pulp being produced in high yields of the order of 85% or more, based on the dry weight of the lignocellulose employed in their manufacture. Obtaining the pulp products in yields of this order of magnitude obviously results in a highly significant saving in pulp cost. It also results in a highly significant conservation of the timber resource.

Still other objects of the present invention are the provision of a process for making cellulosic pulps in high yield and at low cost which is applicable to a wide range of lignocellulosic starting materials; which is easily and rapidly carried out in simply relatively low cost equipment; which requires but a single low cost pulping chemical, available universally in unlimited quantities; and which is characterized by relatively moderate power requirements as well as by minimum problems of waste disposal, since minimum effluent is produced.

BRIEF SUMMARY OF THE INVENTION

The present invention is predicated on the discovery that when lignocellulose is mechanically defibered in an atmosphere of steam, as in an Asplund defibrator, the cellulosic fibers are separated from the woody matrix in which they are contained and are opened up and fibrillated in such a manner that they become peculiarly susceptible to the pulping action of a relatively mild pulping agent under relatively mild pulping conditions.

This leads to the production of an 85% or better yield of a pulp having properties which make it well suited for use in certain applications, such as in the manufacture of hydrated cellulosic gels.

Generally stated, the presently described process for making high yield, low cost, cellulosic pulps comprises mechanically defibrating lignocellulose in an atmosphere of steam at a pressure of, for example, from 100 to 170 psi and corresponding temperatures for saturated steam, for a time sufficient to reduce the lignocellulose to an aqueous fibrous product, the component fibers of which are reduced to a Clark classifier fiber size of less than 10% plus 12 mesh.

The resulting fiber product is mixed with a lignocellulose-pulping quantity, i.e. from 1 to 20% by weight, dry fiber basis, of finely divided lime. This preferably is added to the fiber in the final stages of its defibration.

The fiber-lime mixture then is digested at, for example, pressures of 75 to 125 psi and corresponding temperatures for saturated steam until a predetermined degree of pulp digestion has been achieved. In a typical instance, this requires heating to temperature over a period of from 30 to 90 minutes, and maintaining the cook at temperature over a period of from 5 to 60 minutes.

After the cooking has been completed, the pulp is ready for application to selected uses without washing.

DESCRIPTION OF PREFERRED EMBODIMENTS OF THE INVENTION

Considering the foregoing in greater detail:

The process of the invention is applicable to a wide diversity of lignocellulosic raw materials. Thus it is applicable to various species of wood, in particular pine, fir, spruce, hemlock, the various hardwoods and eucalyptus. It also is applicable to such waste vegetable products as straw, cornstalks and bagasse. Except in the case of the Douglas fir and other trees having massive bark, the woody raw material need not first be debarked. Bark in moderate quantities does not interfere with the process. The material should, however, be reduced to chips having a size suitable for handling in the apparatus concerned.

In the first step of the process of the invention, the lignocellulose is defibered mechanically in an atmosphere of steam. The mechanical defibering procedure of the invention comprises an abrasion or attrition operation in which the lignocellulose is rubbed between plates under conditions such that the cellulosic fibers are separated in large degree from the lignin matrix in which they are encased, opening up and fibrillating the fibers so that they are receptive to subsequent chemical treatment.

Although not limited thereto, the defibration of the lignocellulose preferably is effectuated in apparatus of the class of the well-known Asplund defibrator in which wood chips are abraded between plates under pressure in a controlled steam environment.

To achieve the desired results, the mechanical defibration of the lignocellulose should be carried out under steam pressure of from 100 to 170 pounds per square inch and corresponding temperatures for saturated steam. The defibration is continued to a degree sufficient to reduce the lignocellulose to a fiber product of the desired size and characteristics, with regard particularly to its susceptibility to subsequent treatment with the pulping chemical.

The mechanical attrition of the lignocellulose preferably is carried out in two stages. In the first, it is reduced in the presence of steam to a Clark classifier fiber size of less than about 20% plus 12 mesh. In this state, the solid lignocellulose is converted to a fiber product having a solids content of about 40% and a water content of about 60% by weight. The water is derived from the inherent water content of the lignocellulose, as well as from the condensation of the steam used as a treating agent in the defibrator. In the case of drier chips, some water is added to the defibrator.

In the second stage, which may be carried out to advantage at atmospheric pressure and temperature in an Asplund Raffinator, the solid content of the pulp is reduced further to a Clark classifier fiber size of, for example, 10% plus 12 mesh. The raffinator operates at atmospheric pressure, but sufficient water is introduced to result in the formation of an aqueous pulp containing, for example, 20% by weight solids, dry fiber basis and 80% water.

In the second major step of the hereindescribed procedure, the lignocellulosic fiber obtained from the refiners is treated with lime under controlled and relatively mild cooking conditions predetermined to convert the fiber to a pulp having desired gel-making properties without solubilizing an excessive amount of the lignocellulose, thereby insuring the production of a pulp product in high yields.

Accordingly the fiber is transferred to a papermaking pulp digester of suitable type. A ball-type digester is preferred, since in such a digester provision is made to prevent channeling of the pulping chemicals.

Before or subsequent to its addition to the digester, the fiber is combined with additional water to adjust its consistency to a level of from 10 to 25%. A consistency of about 18% is preferred.

Although the lime may be added to the fiber in the digester, so doing may result in the complication of causing the fibers to ball up, or felt. This is undesirable since it interferes with the digestion procedure and in particular makes difficult uniform cooking of the pulp.

Accordingly it is preferred to add the lime to the defibrating apparatus during its final stages of operation, i.e. to the raffinator. It is added as milk of lime, i.e. as an aqueous solution or suspension of unslaked lime in water. The raffinator thereupon disperses the lime throughout the pulp and mixes it in so that it is distributed uniformly, without inducing felting of the component fibers of the pulp.

The lime is employed in amount which, broadly stated, will achieve the desired degree of pulping of the lignocellulose content of the pulp. More specifically, it is admixed with the pulp in amount of from 1% to 20% by weight, preferably from 5% to 15% by weight, dry solids basis.

Since the wood of the eucalyptus has an inherent pH of about 4, and since the woods of other species also are acidic in character, the lime has the effect of neutralizing the wood acids and establishing a desired alkaline pH in the digester. For the present purpose, it is essential to establish such a pH in order to achieve the desired pulping of the digester charge. If the final pH after cooking is lower than about pH 6, the digester charge under reasonable operating conditions will be only partially cooked. The final pH accordingly should be from pH 6 to pH 8. A preferred final pH value is pH 7.5.

The digester charge is cooked until the pulp has developed its desired properties. In general, it is cooked at from 75 to 125 pounds per square inch steam pressure and corresponding temperatures for saturated steam until the desired final pH has been reached, e.g. a pH of not below 6, preferably one of about 7.5. The cooking times are from 30 to 90 minutes to temperature and from 5 to 60 minutes at temperature. In a typical instance, using a eucalyptus pulp slurry at a consistency of 18%, the charge is cooked at 100 pounds steam pressure and 164° C. for a cooking time of one hour to temperature and 15 to 40 minutes at temperature.

At the conclusion of the cooking operation, the digester is blown and the charge preferably transferred to a conventional hydrapulper. It is maintained in the hydrapulper a sufficient length of time to break up any fibrous lumps, as well as to open up and separate the individual fibers, thus establishing a uniform pulp.

Thereafter the pulp is washed if necessary, and air dried if it is desired to store or transport it. As noted above, it is a feature of the invention that the pulp need not be drained, thereby avoiding an effluent disposal problem. Also, the washing step in most cases may be omitted.

The end product of the procedure is a uniform cellulosic pulp produced in yields of the order of 85%. It may be applied directly to its various end uses, such as the manufacture of a hydrated cellulosic gel product.

EXAMPLES

The process of the invention is illustrated by the following examples:

EXAMPLE 1

This example illustrates a typical procedure to be followed in executing the process of the invention.

1000 Kilograms of eucalyptus wood chips having a pH of 4.2 were fed to an Asplund defibrator operating at 155 pounds per square inch steam pressure and a temperature of 183° C. The chips were defibrated to a Clark classifier fiber size of less than 20% plus 12 mesh, resulting in the formation of a fiber containing 40% solids and 60% water.

This fiber was fed to an Asplund raffinator operated at atmospheric pressure and 60° C. A milk of lime suspension containing 10% lime solids together with a proportion of added water was introduced into the raffinator, in the proportion of 10% of suspended lime solids per unit dry weight of wood fiber contained in the pulp. The fiber discharged from the raffinator had a fiber size of 10% plus 12 mesh. It was discharged from the raffinator in the form of a pulp slurry containing 20% fiber and 80% water, the extra water having been introduced with the milk of lime.

The resulting mixture of pulp and lime discharged from the raffinator was fed to a ball-type digester of the class employed for digesting wood with pulping chemicals.

In the digester, the consistency of the pulp was adjusted to 18%. It was subjected to the cooking action of steam at a pressure of 100 pounds per square inch and a temperature of 164° C., using a cooking time of one hour to temperature and 15 minutes at temperature, during which time the pH fell to a value of 7.5.

At the conclusion of the cooking period, the digester was blown and the product hydrapulped. The final product was an 85% yield of cellulosic pulp applicable without further treatment to its various end uses, including its conversion to hydrated cellulosic gel products, by beating in aqueous medium.

Having thus described my invention in preferred embodiments, I claim:

1. The process of making high yield low cost cellulosic pulp which comprises:

(a) mechanically defiberizing lignocellulose by mechanically abrading lignocellulose pieces in an atmosphere of steam at a pressure of from 100 to 170 psi and corresponding temperatures for saturated steam for a time sufficient to reduce the lignocellulose to a fibrous product having a Clark classifier fiber size of less than 10% plus 12 mesh, (b) mixing with the fibrous product from 1% to 20% by weight, dry fiber basis, of lime, (c) adjusting the consistency of the resulting mixture of aqueous lignocellulosic pulp and lime to a consistency of from 10 to 25%, (d) digesting the fiber to pulp form in the presence of the lime to a final pH of from 6 to 8 at steam pressures of from 75 to 125 psi and corresponding temperatures for saturated steam for a digestion period of from 30 to 90 minutes to digestion temperature and from 5 to 60 minutes at said digestion temperature, and (e) mechanically beating the resulting digested fiber in aqueous medium until it is substantially converted to a hydrated cellulosic gel product.

2. The process of claim 1 wherein the lignocellulose is defiberized in a first stage to a Clark classifier fiber size of less than 20% plus 12 mesh and in a second stage to said Clark classifier fiber size of less than 10% plus 12 mesh.

3. The process of claim 1 wherein the fiber is mixed with from 5 to 15% by weight, dry fiber basis, of finely divided lime.

4. The process of claim 1 including the step of hydrapulping the digested fiber for a time sufficient to break up fibrous clumps and open up and separate the component fibers of the pulp.

5. The process of claim 1 wherein the lignocellulose is wood.

6. The process of claim 1 wherein the lime is added as milk of lime.

7. The process of claim 1 wherein the lime is mixed with the fibrous product during the final stages of the defiberizing operation.

* * * * *